United States Patent [19]

Thon

[11] 4,106,787

[45] Aug. 15, 1978

[54] DEVICE FOR LOCKING A REMOVABLE SKI CROSSING DEFLECTOR

[75] Inventor: Dieter Thon, Munich, Fed. Rep. of Germany

[73] Assignee: Safety Jet, Munich, Fed. Rep. of Germany

[21] Appl. No.: 748,614

[22] Filed: Dec. 8, 1976

[30] Foreign Application Priority Data

Dec. 10, 1975 [DE] Fed. Rep. of Germany ... 7539332[U]

[51] Int. Cl.[2] ..... A63C 11/00

[52] U.S. Cl. ..... 280/11.37 E; 85/5 P

[58] Field of Search ..... 280/11.37 E, 601; 85/5 P, 7

[56] References Cited

U.S. PATENT DOCUMENTS

| | | | |
|---|---|---|---|
| 2,124,912 | 7/1938 | Ehmann | 85/7 |
| 3,951,421 | 4/1976 | Brangenberg | 280/601 |

FOREIGN PATENT DOCUMENTS

| | | | |
|---|---|---|---|
| 2,556,871 | 7/1976 | Fed. Rep. of Germany | 280/11.37 E |
| 2,441,590 | 3/1975 | Fed. Rep. of Germany | 280/11.37 E |

*Primary Examiner*—David M. Mitchell

*Attorney, Agent, or Firm*—William Anthony Drucker

[57] ABSTRACT

This invention relates to a device for removably locking a crossing deflector to a ski. The device includes a base plate fixed to the ski and a removably locking pin which holds the crossing deflector to the base plate.

12 Claims, 5 Drawing Figures

DEVICE FOR LOCKING A REMOVABLE SKI CROSSING DEFLECTOR

Ski attachments are known which prevent inadvertent or unintentional crossing of the skis during skiing which consist of a base plate to be mounted on the ski. The ski deflection part is introduced into said base plate and is secured by means of a cotter pin. It is disadvantageous, however, that the cotter pin does not possess a fixed in-operative position even when in the locked position so that it can project like a hook while skiing or during a ski accident, thus increasing extensively the risk of injury. The danger of injury is increased even further in that the base plate of the known removable ski attachment consists of metal. The sides of said base plate which extend transversely to the ski are bent upright in the shape of an edge and are provided with holes through which the lock bolt is inserted. If the ski deflection part is removed by withdrawing the lock bolt and the ski attachment removed, the metal base plate with the bent side edges remains on the ski. If the skis are transported or used in this manner without the inserted ski deflector part, the consequence is a considerable increase in the danger of injury during accidents and considerable danger of damage to the skiing surfaces of a ski which crosses or rides over another ski.

In order to obviate these drawbacks, a locking device is proposed which consists substantially of a lock bolt or cotter pin and a base plate of a tough, hard plastic, preferably fiberglass-reinforced polypropylene or polyamide. The cotter pin and the base plate are functionally adapted to one another by means of snap-like projections and recesses such that the cotter pin can be shifted out of its locked position only by the application of force. With an eye to safety, it is especially advantageous if the base plate and/or the cotter pin can consist of a tough, impactproof plastic material, in particular polypropylenes or polyamides which may be reinforced with fiberglass as the case may be. If this material is used, in particular the upright side edges of the base plate can be designed with round, beaded contours. The side edges designed in this way can also have cavities as the case may be into which one or both ends of the cotter pin extend so that the ends of the cotter pin are sunk in the side wall and cannot cause any injuries.

The subject matter of the invention includes also ski attachments for preventing the unintentional crossing of skis during skiing which consist of a base plate to be mounted firmly on the ski and a frame which is mounted removably on the base plate. A resilient intermediate layer can be provided between both parts if desired and locking can be effected by means of the locking device in accordance with the invention.

Another known ski attachment has an eye on the base plate which projects through an opening in the lower wall (bottom) of the frame during use and which is engaged by a locking handle which keeps the frame under tension on the base plate and on the intermediate resilient layer.

It has been found in practice, however, that this ski attachment has various drawbacks which reduce its value in use. For instance, the central clamping by the locking handle in conjunction with the eye does not secure the frame in position on the base plate in a sufficiently rigid manner so that impacts acting on the frame can pivot this relative to the base plate and thus relative to the ski. This impairs the aesthetic appearance on the one hand and increases the danger of destruction of the frame by impacts on the other hand. In particular, there is a danger of unintentional opening of the locking handle by such impacts. Moreover, there is also a danger that the relatively small locking handle will get lost. In addtion, a bead extending over the entire length of the baseplate transversely to the length of the ski and provided for attaching the eye to the baseplate tends to counteract the dampening effect which the intermediate resilient layer attempts to achieve, since the intermediate resilient layer is squeezed away almost completely adjacent the bead.

The inventive ski crossing deflector is characterized in that the base plate has upwardly extending walls on two opposing sides between which the lower surface of the frame is received positively, and that the side walls of the base plate are respectively designed to receive the locking pin in accordance with the invention. This ski crossing deflector is thus less complicated and less expensive in manufacture as compared to the known art, since it has one less construction part.

The sides of the base plate supporting the walls preferably are convex. It is also possible for the sides of the base plate supporting the walls to be concave. In any case, however, an especially good positive connection is achieved between the base plate and the frame.

The base plate expediently supports the intermediate layer. This readily permits the use of the same frames which have already been employed as ski attachments to be mounted firmly to the skis.

The ski attachment surface of the base plate of the ski crossing deflector in accordance with the invention advantageously has an adhesive which is covered on the outside by a removable protective sheet. The adhesive is preferably applied to the ski attachment surface in the form of a thin coating which has an open-pored foam rubber strip which has been impregnated with the adhesive solution or emulsion as the substrate material. A foam rubber strip of polyurethane less than 0.8 mm thick is especially preferably, in particular if an inorganic adhesive is employed as the adhesive.

The invention will now be explained in more detail with reference to the following FIGS. 1 to 5, in which.

Figure 1:
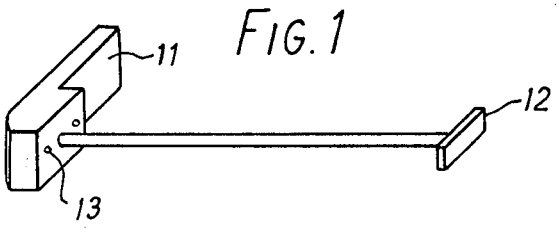
FIG. 1 is an embodiment of the cotter pin in accordance with the invention.
Figure 2:
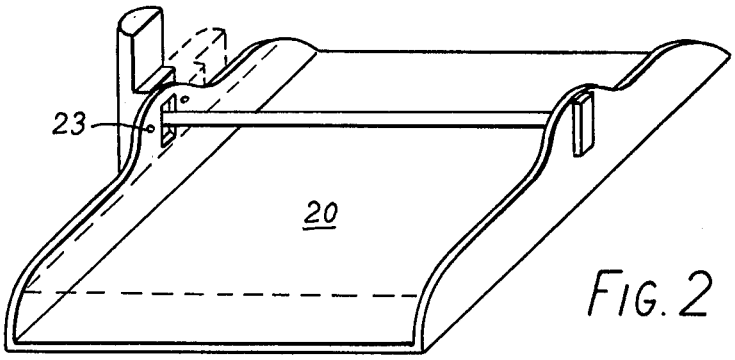
FIG. 2 illustrates the base plate with the inserted cotter pin.

In the embodiment according to FIG. 1 the inventive cotter pin consists of the handle 11 and the T-shaped end 12 of the cotter pin. The handle 11 has the snap-like projections 13 which co-operate with the base plate during locking. FIG. 2 shows the base plate with the cotter pin inserted through the slot-like openings in the bent side edges of said base plate. By rotating the inserted cotter pin by 90°, the cotter pin and thus the segment of the deflection part located between the base plate and the cotter pin is locked in position. The projections on the handle of the cotter pin snap like a pushbutton snap into the corresponding recesses 23 in the side edges of the base plate which act as the cotter pin bearing.

Figure 3:
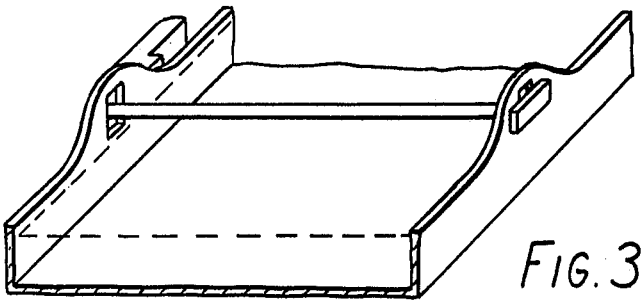
FIG. 3 illustrates the base plate and the cotter pin in the locked position.

In FIG. 3 the locking cotter pin is illustrated in its locked position. It is clear that the end of the cotter pin which has a rectangular design in the drawing can have any shape relative to the opening in the side edge through which it passes, provided that this shape does not permit the cotter pin to pass through the opening after it has been inserted and rotated by 90°, for example, thereby preventing removal of the cotter pin through the opening in the locked position.

Figure 4:
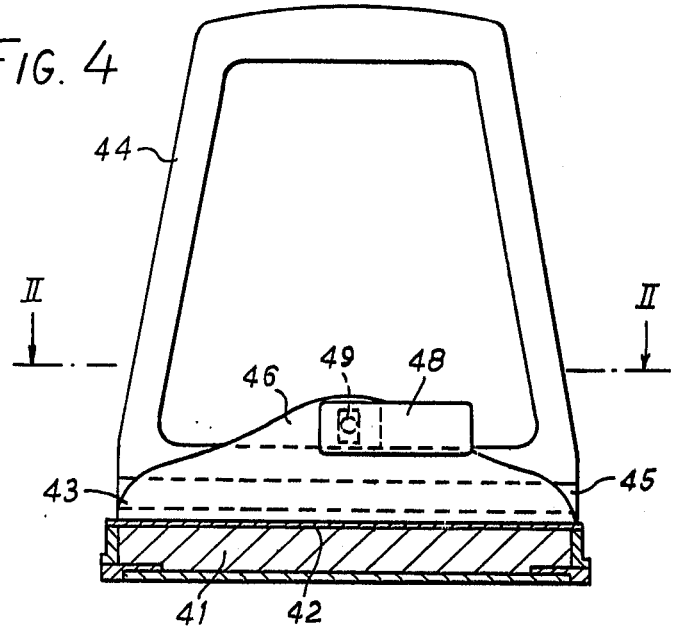
FIG. 4 is an elevation of a mounted ski crossing deflector as seen in the longitudinal direction of the ski.

In FIG. 4 the ski crossing deflector in accordance with the invention is shown mounted on a ski. The deflection part 44 is locked in the base plate 46 by the cotter pin 48 in the manner described hereinbefore. If necessary, the deflection part 44 can have projections or the like adjacent the axis of the locking cotten pin which prevent any possible displacement or sliding of the deflection part 44 in a direction transversely to the axis of the cotter pin. The same can be achieved in that, deviating from the figures, the base plate and the base surface of the deflection part 44 which fits into the base plate are not designed rectangularly, but rather in a shape which prevents sliding or displacement in the given direction. Reference numeral 45 indicates the intermediate resilient layer consisting of foam rubber, for example, which can be positioned if desired between the location of the deflection part 44 and the corresponding inner surface of the base plate 46. The under surface 43 of the base plate is connected with the ski 41 by means of the adhesive foil 42 described hereinbefore.

Figure 5:
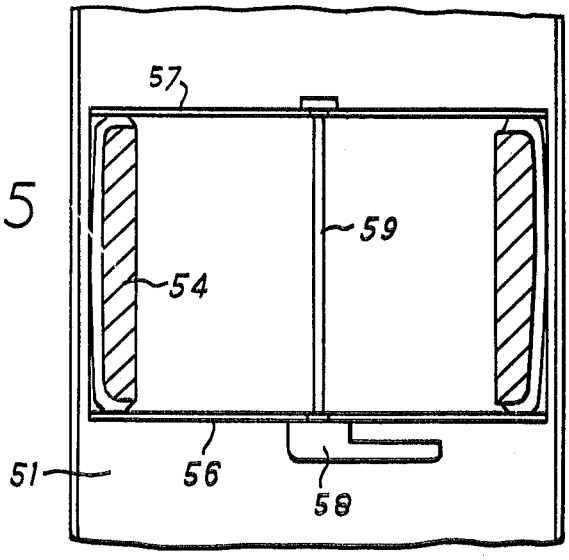
FIG. 5 is a sectional elevation through the ski crossing deflector along line II—II of FIG. 4.

The sectional elevation along line II—II in FIG. 4 is represented in FIG. 5 in which the opposing side edges 56 and 57 of the base plate, which can be designed in a concave or convex and/or in a bead-like shape instead of straight if desired, as well as the cotter pin axis 59 and the cotter pin handle 58 with the snaplike devices for locking the cotter pin as well as the cross section through the deflection part 54 and the ski surface 51 are illustrated.

What is claimed is:

1. A device, for locking a ski-crossing deflector on a ski, which comprises:

(i) a base plate including a base to be secured to a ski, and a pair of side portions upstanding on said base and spaced transversely of the base, each of said side portions including a respective substantially rectangular opening and said openings being aligned transversely of the base, one of said side portions including a recess opening at its outer face, the base plate being resiliently deformable to permit movement of the side portions towards and away from each other, (ii) a cotter pin for insertion through the side portions to serve for clamping a ski-crossing deflector onto the base, said cotter pin having at one end a T-shaped configuration in which the cross-piece of the "T" is shaped similarly to but is of smaller dimensions than the substantially rectangular openings of the side portions, such that the T-shaped configuration can pass through the openings when the cross-piece is aligned longitudinally with the openings but is prevented from passing through the openings when cotter pin is rotated so that the cross-piece is not aligned with the openings, said cotter pin having at its other end a handle portion having on a face thereof abutting said one side portion a projection which is positioned to engage into said recess, when the cotter pin is in a position of rotation in which the cross-piece is not aligned with the opening of the other side portion, thereby to retain the cotter pin in said position of rotation, said projection being releasable from said recess by forcible rotation of the cotter pin and resilient movement of the side portions towards each other.

2. The device of claim 1 wherein the base plate is made of a tough impact-proof plastics material.

3. The device of claim 2, wherein the plastics material of the base plate is selected from the group consisting of polypropylenes and polyamides.

4. The device of claim 2, wherein the plastics material is reinforced with fiberglass.

5. The device of claim 1 wherein the base plate has adhesive thereon for securing it to a ski.

6. The device of claim 1 wherein the base plate has, on a surface thereof to be secured to a ski, a strip of open-pored foam material impregnated with adhesive.

7. The device of claim 6 wherein the foam material is polyurethane and has a thickness of less than 0.8 mm.

8. In combination, a device for locking a ski-crossing deflector on a ski and a ski-crossing deflector, wherein said locking device comprises:

(i) a base plate including a base to be secured to a ski, and a pair of side portions upstanding on said base and spaced transversely of the base, each of said side portions including a respective substantially rectangular opening and said opening being aligned transversely of the base, one of said side portions including a recess opening at its outer face, the base plate being resiliently deformable to permit movement of the side portions towards and away from each other, (ii) a cotter pin for insertion through the side portions to serve for clamping the ski-crossing deflector onto the base, said cotter pin having at one end a T-shaped configuration in which the cross-piece of the "T" is shaped similarly to but is of smaller dimensions than the substantially rectangular openings of the side portions, such that the T-shaped configuration can pass through the openings when the cross-piece is aligned longitudinally with the openings but is prevented from passing through the openings when cotter pin is rotated so that the cross-piece is not aligned with the openings, said cotter pin having at its other end a handle portion having on a face thereof abutting said one side portion a projection which is positioned to engage into said recess, when the cotter pin is in a position of rotation in which the cross-piece is not aligned with the opning of the other side portion, thereby to retain the cotter pin in said position of rotation, said projection being releasable from said recess by forcible rotation of the cotter pin and resilient movement of the side portions towards each other; and wherein said ski-crossing deflector is positioned on said base between said side portions and locked onto the base portion by said cotter pin.

9. The combination of claim 8, further including a layer of resiliently compressible material interposed between the ski-crossing deflector and the base.

10. The combination of claim 8, further including adhesive on the base plate for securing it to a ski.

11. The combination of claim 8, further including, on a surface of the base plate to be secured to the ski, a strip of open-pored foam material impregnated with adhesive.

12. The combination of claim 11 wherein the foam material is polyurethane and has a thickness less than 0.8 mm.

* * * * *